US008918945B2

(12) United States Patent
Kwon et al.

(10) Patent No.: US 8,918,945 B2
(45) Date of Patent: Dec. 30, 2014

(54) TOOTHBRUSH WITH NEEDLE-SHAPED BRISTLES FOR IMPROVING TOOTH AND GUM CONTACTING FORCE AND TEETH-CLEANING PERFORMANCE, AND METHOD FOR MANUFACTURING SAME

(75) Inventors: Young-Jun Kwon, Gyunggi-do (KR); Sung-Wook Kwon, Seoul (KR); Sung-Hwan Kwon, Seoul (KR)

(73) Assignee: Best Whasung Co., Ltd., Gyunggi-Do (KR)

( * ) Notice: Subject to any disclaimer, the term of this patent is extended or adjusted under 35 U.S.C. 154(b) by 304 days.

(21) Appl. No.: 13/387,461

(22) PCT Filed: Jul. 28, 2010

(86) PCT No.: PCT/KR2010/004949
§ 371 (c)(1),
(2), (4) Date: Mar. 28, 2012

(87) PCT Pub. No.: WO2011/014000
PCT Pub. Date: Feb. 3, 2011

(65) Prior Publication Data

US 2012/0174331 A1 Jul. 12, 2012

(30) Foreign Application Priority Data

Jul. 31, 2009 (KR) ..... 10-2009-0070652

(51) Int. Cl.

| | |
|---|---|
| ***A46B 9/04*** | (2006.01) |
| ***A46B 9/02*** | (2006.01) |
| ***A46D 1/00*** | (2006.01) |
| ***A46D 1/05*** | (2006.01) |
| *A46B 9/06* | (2006.01) |

(52) U.S. Cl.
CPC . *A61B 9/04* (2013.01); *A46B 9/028* (2013.01); *A46D 1/0276* (2013.01); *A46D 1/05* (2013.01); *A46B 9/06* (2013.01)
USPC ..... 15/167.1; 15/207.2

(58) Field of Classification Search
CPC ..... A46B 9/04
USPC ..... 15/167.1, DIG. 5, 207.2
See application file for complete search history.

(56) References Cited

U.S. PATENT DOCUMENTS

| | | | | |
|---|---|---|---|---|
| 7,134,162 | B2 * | 11/2006 | Kweon et al. | 15/167.1 |
| 2002/0116778 | A1 * | 8/2002 | Kwon | 15/167.1 |
| 2004/0103492 | A1 * | 6/2004 | Kwon et al. | 15/167.1 |
| 2008/0028558 | A1 * | 2/2008 | Kwon | 15/167.1 |

FOREIGN PATENT DOCUMENTS

| | | | |
|---|---|---|---|
| KR | 10-2004-0080616 | * | 9/2004 |
| KR | 10-2006-0107231 | * | 10/2006 |

OTHER PUBLICATIONS

International Search Report for corresponding International Application No. PCT/KR2010/004949, (Apr. 2011).

* cited by examiner

*Primary Examiner* — Randall Chin
(74) *Attorney, Agent, or Firm* — Egbert Law Offices, PLLC

(57) ABSTRACT

A toothbrush having needle-shaped bristles on the head portion is configured such that the differences in height between the longer and shorter bristles is 1 to 4 mm, the end points of the longer bristles are 0.01 to 0.03 mm in diameter, the end points of the shorter bristles are 0.03 to 0.08 mm in diameter, the taper lengths of the longer bristles are 4 to 8 mm, the taper lengths of the shorter bristles are 2 to 6 mm, and the differences in taper length between the longer and shorter bristles is 1 to 4 mm. The toothbrush provides superior teeth and gum contact force unique to a toothbrush having needle-shaped bristles and at the same time also provides superior cleaning performance for the surface of teeth thanks to the action of the shorter bristles having relatively large diameters at end points and relatively short taper lengths.

4 Claims, No Drawings

TOOTHBRUSH WITH NEEDLE-SHAPED BRISTLES FOR IMPROVING TOOTH AND GUM CONTACTING FORCE AND TEETH-CLEANING PERFORMANCE, AND METHOD FOR MANUFACTURING SAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates, in general, to a toothbrush having needle-shaped bristles, in particular, to a toothbrush having needle-shaped bristles which has improved in terms of the teeth and gum contact force as well as the teeth cleaning-performance and has a prolonged lifespan.

A needle shaped bristle refers to a bristle having an end point with a diameter of 0.01 to 0.08 mm. Needle-shaped bristles are commonly used as the material for high quality toothbrushes because they are soft and the force with which they contact the area between a tooth and a tooth or between a tooth and a gum is excellent.

Despite of the advantages described above, disadvantages of the toothbrush having the needle-shaped bristles include insufficient tooth cleaning performance and a short lifespan. The toothbrush has additional disadvantages such as a high error rate and a high production cost because two soaking processes are required to taper both end portions of a bristle.

2. Description of Related Art Including Information Disclosed Under 37 CFR 1.97 and 37 CFR 1.98

Various methods have been attempted to solve the problem of the toothbrush having the needle-shaped bristles discussed above. Toray Industries Inc. of Japan has attempted to solve this problem by setting half-folded bristles of which one side is tapered and the other side is not tapered (Japanese Utility Model Application Laid-Open No. Sho. 61-10495). Although this technology eliminates some of the drawbacks of the toothbrush having the needle-shaped bristles, it creates the new problem of the sharp cut edge of the non-tapered bristles hurting the gums during brushing of the teeth.

Korean Patent No. 10-0590608 discloses a technology for solving the above-discussed problem, and was invented by the present inventors. This technology solves the above-discussed problem by using a manner of grinding the sharp cut edge of a bristle with a grinder, tapering the opposite side of the bristle with chemicals, and then setting the bristle. This technology has solved the problems of the above-mentioned technology, but the obtained toothbrush still has the problems of the force of contact with the teeth and gum being slightly insufficient and an additional grinding process being required.

In Korean Registered Utility Model No. 20-0308084, needleshaped bristles having an equal taper length and an equal diameter at their end points are asymmetrically set so that left and right sides of the bristles have a deviation in height. With this setting, the teeth and gum contacting force is slightly improved, but the cleaning performance is still insufficient. In addition, thus obtained toothbrush still has problems of the lifespan being shorter than that of the toothbrush having general needle-shaped bristles, and the error rate remaining high because two soaking processes are still required.

Japanese Patent Application Laid-Open No. Heisei. 10-225324 introduces a toothbrush where both ends of each bristle have different taper lengths, and the bristles are set in such a manner that the part of the bristle with the longer taper length is used as a longer bristle and the part of the bristle with the shorter taper length is used as a shorter bristle. This technology slightly improves the teeth and gum contact force, but still has the same problem as does the general toothbrush having needle-shaped bristles because it uses bristles having an equal diameter of the end point. There is another meaningful conventional art related to a toothbrush having needle-shaped bristles, which is Korean Patent No. 10-066457 invented by the present inventor, in which the process of tapering bristles is performed by grinding with a grinding stone having projections without using a chemical immersion process so that the burdensome chemical immersion process can be eliminated. According to the technology, the bristles can be tapered by a physical method. In addition, bristles made of nylon or acryl, which are difficult to taper in the conventional art, can be tapered according to this technology.

The-above discussed technologies are far removed from a toothbrush having a long lifespan and having both the teeth and gum contacting force and the teeth cleaning performance being improved. Among the technologies, the technology which is the closest to the object of the present invention is described in Korean Patent Application No. 10-2003-0015480 invented by the present inventors of this invention.

This technology relates to a toothbrush having longer needle-shaped bristles and shorter needle-shaped bristles both set on the head portion of the toothbrush, and also relates to a toothbrush in which needle-shaped bristles having taper lengths of 3 to 7 mm and end-point diameters of 0.01 to 0.07 mm are set on the head portion in a mixed manner so that bristles are half-folded so as to have a deviation of 0.5 to 2.0 mm between left and right sides and be set on the head portion of the toothbrush. In this manner, most of the objects of the present invention have been achieved, but this technology is still slightly unsatisfactory in terms of the teeth and gum contact force, teeth cleaning performance, and the effect of prolonging the lifespan.

Another method is disclosed in Korean Patent No. 10-0659953 presented by Lion Corporation of Japan. According to the method, provided is a toothbrush using monofilaments in a tapered form where the diameter of the monofilament at a position 0.1 mm from the tip of a tapered portion is 5 to 35% of the maximum diameter (D) of the synthetic monofilament. The toothbrush according to the technology has the same end point on the both sides, and the length of the tapered portion is 8 5 to 15 mm, and preferably 8 to 10 mm. Accordingly, the toothbrush has a short lifespan and lacks teeth cleaning force because the length of the tapered portion is too long. Therefore, the toothbrush is suitable for use as a paint brush or a cosmetic brush, but it is not suitable for use as a toothbrush.

BRIEF SUMMARY OF THE INVENTION

Technical Problem

An object of the present invention is to provide a toothbrush having needle-shaped bristles with the improved teeth and gum contact force and improved teeth cleaning performance along with a prolonged lifespan. Another object of the present invention is to provide a toothbrush that can be manufactured by a simple process and is capable of reducing the error rate. Still another object of the present invention is to provide a toothbrush having needle-shaped bristles that can be manufactured at low cost.

Technical Solution

The toothbrush of the present invention has needle-shaped bristles set on the head portion and is configured in such a manner that the difference in height between the longer and shorter bristles is 1 to 4 mm, the end points of the longer bristles are 0.01 to 0.03 mm in diameter, the end points of the shorter bristles are 0.03 to 0.08 mm in diameter, the taper lengths of the longer bristles are 4 to 8 mm, the taper lengths of the shorter bristles are 2 to 6 mm, and the difference in taper length between the longer and shorter bristles is 1 to 4 mm.

Hereinafter, the present invention will be described in detail.

DETAILED DESCRIPTION OF THE INVENTION

The present invention is an improvement invention of Korean Patent Application No. 10-2003-0015480 (hereinafter referred to as "conventional art") invented by the inventors of the present invention, and solves the problems of the conventional art.

The conventional art has a structure in which the needle-shaped bristles having diameters of 0.01 to 0.07 mm at the end points are randomized. Accordingly, the longer bristles can be 0.03 to 0.07 mm in diameter or the reverse may be true, i.e. that the longer bristles can be 0.01 to 0.03 mm in diameter. In the former case, there is a problem in that since the needle-shaped bristles having relatively large diameters are used as the longer bristles, the contact force between teeth or between the tooth and the gum is reduced.

Since the toothbrush is configured in such a manner that the needle-shaped bristles having diameters of 0.01 to 0.07 mm at the end points are randomized, half of the bristles fall into the former case, and the other half of the bristles fall into the latter case. The teeth and gum contact force is considerably reduced overall.

In the present invention, longer bristles having the endpoint diameters of 0.01 to 0.03 mm are mixed, so that the problem of reduced the teeth and gum contact force can be completely solved. It is preferable that the end-point diameters of all of the longer bristles fall within the above numerical range, but the object of the invention can be achieved even though the diameters of only 80% or more of the longer bristles fall within the above numerical range.

"Randomized" refers to a state in which bristles having end-point diameters of two or more sizes are combined together. The first advantage of a toothbrush with randomized bristles is that it is easier to produce than the toothbrush with bristles having end points of the same size. The second advantage is that the lifespan of the product is prolonged.

Here, "the end-point diameter" refers to the diameter at a point, 0.1 mm from the end. It is common practice in the art to regard the point at 0.1 mm as an end point, since the end portion of needle-shaped bristles that have undergone a chemical immersion process is very thin, and thus easily wears out after being used several times. This practice can be applied not only to needle-shaped bristles obtained by a chemical immersion process, but also to needle-bristles obtained by grinding.

It is also a common practice in the art to round off the diameter of the end points below three decimal points and to express the diameter to two decimal points.

In the toothbrush having the above-described structure according to the present invention, the longer bristles having smaller end-point diameters provide the teeth and gum contact force, and the shorter bristles having larger end-point diameters provide teeth cleaning performance. Therefore, the teeth and gum contacting force and the teeth cleaning performance can be provided at the same time, and also the lifespan of the toothbrush is prolonged because the wearing out of the bristles is delayed compared to conventional needle-shaped bristles having a single-size end-point diameter of 0.02 mm due to the influence of the shorter bristles having the larger end-point diameters and the influence of the mixed bristles having two or more different end-point diameters.

An example of the manufacturing method includes performing a tapering process using a chemical immersion process which makes the end point at one end equal to 0.01 to 0.03 mm in diameter and performing another tapering process using a chemical immersion process which makes the end point at the other end equal to 0.03 to 0.08 mm in diameter. Producing the needle-shaped bristles in which the longer and shorter bristles have differently-sized end points by using two immersion processes is easier than producing the needle-shaped bristles having an equal end-point diameter and results in a reduced error rate. Also, the immersion process wherein the bristles are immersed so that the bristles are imparted with end-point diameters of 0.01 to 0.03 mm is very tricky. It is easy to make erroneous lengths, and the bristles having an end-point diameter other than that desired may be produced. However, the needle-shaped bristles having the end-point diameters of 0.03 to 0.08 mm rarely have incorrect lengths because the chemical reaction is stopped before the lengths become too short.

Another manufacturing methods includes performing a tapering process using a chemical immersion process so that the end-point diameters become 0.03 to 0.08 mm, setting the bristles on the head portion of a toothbrush so that the bristles have a deviation of 1 to 4 mm between left and right sides, and performing a tapering process using a grinding process so that the end-point diameters of the longer bristles are made to be 0.01 to 0.03 mm.

Of course, if the bristles were made of materials such as nylon that do not melt in chemicals, the bristles can be tapered by using a physical method rather than a chemical immersion process, for example, by using the technology described in Korean Patent No. 10-066457 invented by the inventor of the present invention. An example of such a physical method includes imparting the longer and shorter bristles with a deviation of 1 to 4 mm in height, and then grinding the bristles using a grinding machine as described in Korean Patent No. 10-066457. Such processes put the end-point diameters of the longer bristles within the range of 0.01 to 0.03 mm, and the end-point diameters of the shorter bristles within the range of 0.03 to 0.08 mm.

Still another example of the manufacturing method includes a process of grinding one side of a bristle bundle to taper bristles so that bristles having end-point diameters of 0.03 to 0.08 mm are mixed, a chemical immersion process of tapering the other side of the bristle bundle so that bristles having endpoint diameters of 0.01 to 0.03 mm are mixed, and a process of setting the bristles on the head portion of a toothbrush so that the bristles have a horizontal deviation of 1 to 4 mm. Here, the setting of the bristles is performed in such a manner that the side tapered by the chemical immersion process is to be used as the longer bristle.

The reason that the difference between the longer bristles and the shorter bristles is limited to 1 to 4 mm is that the depth of the gingival sulcus of a normal person is around 2 mm, yet 3 mm for some people. When the difference exceeds the range, the longer bristles may stimulate the soft tissue in the gingival sulcus when the teeth are being washed. Therefore, it is not preferable. In addition, when the difference is less than the range, due to the interference of the shorter bristles, the teeth and gum contact force of the longer bristles may be reduced. Therefore, this is not preferable, either. When horizontal deviations are less than the range, the teeth and gum contact force may be insufficiently increased.

The method of setting the longer and shorter bristles to have a horizontal deviation is generally performed by half-folding needle-shaped bristles tapered at both ends so that the lengths of the longer and shorter bristles are different, and then setting the bristles. Also, another method can be used in which the needle-shaped bristles, which have been tapered at one end, are set in a row, and other needle shaped bristles, which have been tapered at the other ends and having a length different from that of the former bristles, are set in another row so that the rows alternate.

When the needle-shaped bristles are half-folded and then set, the ratio between the longer bristles and the shorter bristles is exactly 50:50. However, when the needle-shaped bristles tapered at only one side are set, the ratio can be controlled. In this case, if the ratio of the longer bristles and the shorter bristles are in the range of 30:70 to 70:30, the effect desired to achieve in the present invention can be obtained.

A further method can be used in which needle-shaped bristles corresponding to the longer bristles are half-folded and then set, and needle-shaped bristles corresponding to the shorter bristles are half-folded and then set. In this case, the difference in length between the longer and shorter bristles is 1 to 4 mm. The effect desired in the present invention can be obtained when the ratio of the longer bristles to the shorter bristles ranges from 30:70 to 70:30.

The reason why the taper length is limited to 2 to 8 mm is that, if the taper length is smaller than this, the bristles are excessively strong, so that the softness unique to needle-shaped bristles disappears. The reason why the difference in taper length between the longer bristles and the shorter bristles is limited to 1 to 4 mm is that, when it is less than this range, teeth cleaning performance may become worse, or the effect of prolonging the lifespan may not be expected, and when the difference exceeds the range, the softness unique to needle-shaped bristles may be detracted from.

Advantageous Effects

The toothbrush according to the present invention provides the superior teeth and gum contact force unique to the toothbrush having needle-shaped bristles and at the same time also provides superior cleaning performance for the surface of the teeth by the action of the shorter bristles having a relatively large end-point diameter and a relatively short taper length. In addition, the wearing-out of the end portions of the bristles is delayed by the effect of the shorter bristles, so that the effect of prolonging the lifespan of the toothbrush is provided.

The method of the present invention can minimize the error rate and simplify the processes.

Best Mode

Manufacturing Example 1

Polybutylene terephthalate (PBT) 020T 0.200 W (in a bundle about 50 mm in diameter) manufactured by Toray Industries, Inc. of Japan was cut into lengths of 30.5 mm, 8 mm of PBT was vertically immersed into a 33% caustic soda solution at a temperature of 120° C., then the PBT was taken out of the solution when the end points of the bristles at the center of the bundle had completely dissolved (after 90 minutes), after which the bristles were turned over, and the other ends were immersed in the same way (the second immersion) except that the immersion depth of the bristles was 5 mm.

After the other end had been immersed, when the end-point diameters of the bristles at the center of the bundle were 0.05 mm, the immersion process was stopped and washing and drying was performed.

The end point on one end of the obtained needle-shaped bristles was 0.01 to 0.02 mm in diameter, and the taper length was 7 to 8 mm. The end point on the other end was 0.04 to 0.05 mm in diameter, and the taper length was 4 to 5 mm.

Manufacturing Example 2

Manufacturing Example 2 was performed similarly to Manufacturing Example 1, but the process was maintained for 1 minute from when the end points of the bristles at the center of the bundle in a second immersion process was 0.08 mm in diameter, and then the immersion process was stopped, and washing and drying was performed.

The end points on one end of the obtained needle-shaped bristles varied in the range of 0.01 to 0.02 mm in diameter, but the end points on the other end of the obtained needle-shaped bristles varied in the range of 0.03 to 0.08 mm diameter.

Manufacturing Example 3

Polybutylene terephthalate (PBT) 020T 0.200 W (in bundles about 50 mm in diameter) manufactured by Toray Industries, Inc. of Japan was cut into lengths of 30.5 mm, 8 mm of the PBT was vertically immersed into a 33% caustic soda solution at a temperature of 120° C., and then the PBT was taken out of the solution. After a second immersion process similar to that of Manufacturing Example 2 was performed, the immersion process was stopped and washing and drying was performed.

The obtained needle-shaped bristles having the end-point diameters of 0.01 to 0.03 mm at one ends thereof were mixed. 85% of the bristles were within this numerical range, and the taper lengths were 7 to 8 mm. The end-point diameters of the other ends of the bristles were in the range of 0.03 to 0.08 mm. 88% of the bristles were within this numerical range, and the taper lengths were 4 to 5 mm.

Comparative Manufacturing Example 1

As described in Korean Patent Application No. 10-2003-0015480, after it begins to be observed that bristles have become imparted with an end-point diameter of 0.08 mm, the bristles are left for one more minute and then the immersion process stopped. Washing and drying was performed there-after. In this way, both ends of a bundle of the bristles were tapered, so that needle-shaped bristles having various end-point diameters within the range of 0.01 to 0.08 mm was obtained.

Comparative Manufacturing Example 2

Comparative Manufacturing Example 2 was performed in the same manner as Comparative Manufacturing Example 1 except that the immersion depth of the bristle was 7 mm during the second immersion process.

Example 1

The performance of entering between teeth as well as teeth cleaning performance were evaluated for toothbrushes having needle-shaped bristles obtained by Manufacturing Examples 1 and 2 and Comparative Manufacturing Example 2 in which bristles with an end-point diameter of 0.03 mm or less were used as the longer bristles and bristles with an end-point diameter of 0.03 mm or more were used for the shorter bristles; tooth brushes having needle-shaped bristles obtained by Comparative Manufacturing Examples in which the bristles were set on the head portion of the toothbrushes with a horizontal deviation of 1.5 mm; and a commercially marketed toothbrush having general needle-shaped bristles (a toothbrush having needle-shaped bristles with an end-point diameter of 0.02 mm and a taper length of 6 mm without deviation). The evaluation results are presented in Table 1 below.

The grading of the evaluation is as follows:

VG: Very good

G: Good

N: Normal

NG: Not good

TABLE 1

| Classification | Entering performance | Teeth cleaning performance |
|---|---|---|
| Manufacturing Example 1 | VG | G |
| Manufacturing Example 2 | VG | G |
| Manufacturing Example 3 | G | G |
| Comparative Manufacturing Example 1 | N | G |
| Comparative Manufacturing Example 2 | VG | N |
| Toothbrush having general needle-shaped bristles | VG | NG |

** A toothbrush having general needle-shaped bristles refers to a toothbrush having needle-shaped bristles of which the end-point diameter is 0.02 mm, and the taper length is 6 mm without deviation.

Example 2

The lifespan of the toothbrushes used in Example 1 was evaluated by using a model cleaning test machine to calculate the spreading ratio of a bristle setting portion. The test conditions under which the lifespan of the toothbrush was calculated were as follows, and the results were presented in Table 2 below.

(Test Condition)

Weight: 20 g

Back and Forth Stroke: 40 mm

Number of brushing operations: back and forth ten thousand times

Number of samples: 10 samples each

The spreading ratio of the bristle setting portion: (the width of the bristle setting portion after cleaning−the width of the bristle setting portion before cleaning)÷the width of the bristle setting portion before cleaning×100.

TABLE 2

| Classification | Spreading ratio of bristle setting portion |
|---|---|
| Manufacturing Example 1 | 8.5% |
| Manufacturing Example 2 | 8.2% |
| Manufacturing Example 3 | 8.0% |
| Comparative Manufacturing Example 1 | 7.8% |
| Comparative Manufacturing Example 2 | 11.5% |
| Toothbrush having general needle-shaped bristles | 18.7% |

Manufacturing Example 4

Bristles were immersed into a caustic soda solution to obtain needle-shaped bristles with end-point diameters dispersed within the range of 0.03 to 0.08 mm, the taper lengths at one end being 5 mm and the taper length at the other end being 3 mm. The needle shaped bristles were set in the head portion of a toothbrush to have a horizontal deviation of 1.5 mm, and were grinded by a grinder so that the diameter of the end points was 0.01 to 0.03 mm.

The physical properties of the obtained toothbrush were practically the same as the toothbrush obtained by Manufacturing Example 2.

We claim:

1. A toothbrush comprising:

a head portion;

a plurality of long needle-shaped bristles affixed to said head portion; and a plurality of short needle-shaped bristles affixed to said head portion, the short needle-shaped bristles having a height that is different by between 1 to 4 millimeters than a height of the long needle-shaped bristles, said plurality of long needle-shaped bristles having differing end diameters ranging between 0.01 and 0.03 millimeters, said plurality of short needle-shaped bristles having differing end diameters between more than 0.03 and up to 0.08 millimeters, each of said plurality of long needle-shaped bristles having a taper extending to the end diameter, a length of said taper being between 4 and 8 millimeters, each of said plurality of short needle-shaped bristles having a taper extending to the end diameter thereof, said taper of the short needle-shaped bristles having a length of between 2 and 6 millimeters, the length of the taper of the long needle-shaped bristles between 1 and 4 millimeters different than a length of the taper of the short needle-shaped bristles.

2. The toothbrush of claim 1, the end diameter of 80% or more of the needle-shaped bristles being between 0.01 and 0.03 millimeters.

3. The toothbrush of claim 1, the end diameters of 80% or more of the short needle-shaped bristles being between more than 0.03 up to 0.08 millimeters.

4. The toothbrush of claim 1, a number of said plurality of long needle-shaped bristles being in a ratio of between 70:30 and 30:70 with respect to a number of said plurality of short needle-shaped bristles.

* * * * *